US012275548B2

(12) United States Patent
Gabusi

(10) Patent No.: US 12,275,548 B2
(45) Date of Patent: Apr. 15, 2025

(54) APPARATUS AND METHOD FOR AUTOMATICALLY STRETCHING AN OPENING FLAP OF CLOSED PACKAGINGS

(71) Applicant: I.M.A. INDUSTRIA MACCHINE AUTOMATICHE S.P.A., Ozzano Dell'Emilia (IT)

(72) Inventor: Gabriele Gabusi, Ozzano Dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 0 days.

(21) Appl. No.: 18/280,572

(22) PCT Filed: Feb. 23, 2022

(86) PCT No.: PCT/IT2022/050032
§ 371 (c)(1),
(2) Date: Sep. 6, 2023

(87) PCT Pub. No.: WO2022/190148
PCT Pub. Date: Sep. 15, 2022

(65) Prior Publication Data

US 2024/0150060 A1 May 9, 2024

(30) Foreign Application Priority Data

Mar. 10, 2021 (IT) ..... 102021000005546

(51) Int. Cl.
*B65B 69/00* (2006.01)

(52) U.S. Cl.
CPC ..... *B65B 69/0008* (2013.01)

(58) Field of Classification Search
USPC ..... 53/492
See application file for complete search history.

(56) References Cited

U.S. PATENT DOCUMENTS

| | | | | |
|---|---|---|---|---|
| 3,958,390 | A * | 5/1976 | Pringle, Jr. | B29C 66/4322 53/511 |
| 2011/0139650 | A1 | 6/2011 | Dworak | |
| 2012/0006717 | A1* | 1/2012 | Zambaux | A61L 2/04 206/524.6 |
| 2014/0262894 | A1* | 9/2014 | Jansen | B32B 27/12 206/439 |
| 2018/0079539 | A1* | 3/2018 | Borgström | B65B 43/465 |

FOREIGN PATENT DOCUMENTS

DE 10 2014 201 967 8/2015

OTHER PUBLICATIONS

International Search Report filed in PCT/IT2022/050032 mailed Sep. 6, 2022.

* cited by examiner

*Primary Examiner* — Chinyere J Rushing-Tucker
(74) *Attorney, Agent, or Firm* — Rankin, Hill & Clark LLP

(57) ABSTRACT

Apparatus for stretching an opening flap of a closed packaging containing at least one object includes an insufflation device configured to cooperate with a breathable portion of the packaging to insufflate gas under pressure inside it in order to make the opening flap identifiable and available for a subsequent treatment thereof.

11 Claims, 3 Drawing Sheets

APPARATUS AND METHOD FOR AUTOMATICALLY STRETCHING AN OPENING FLAP OF CLOSED PACKAGINGS

FIELD OF THE INVENTION

The present invention concerns an apparatus and the corresponding method for automatically stretching an opening flap of closed packagings, such as for example bags, sacks or sachets of thin and flexible material, such as plastic, paper, fabric or synthetic materials, having at least one portion made of breathable material. The packagings may contain objects, such as for example, but not only, containers, or supports, of bottles, vials, flasks, or suchlike, from the chemical, medical, pharmaceutical, or cosmetic sectors, and are suitably handled to facilitate the identification of one of their opening flaps. In the present description and in the attached claims, by breathable we mean a material which allows the passage of air, or other gases, and prevents the passage of liquids and microorganisms.

BACKGROUND OF THE INVENTION

It is known that in the chemical, medical, pharmaceutical or cosmetic sectors, products and substances can be packaged inside dedicated containers, suitable to contain single or multiple doses, to facilitate the operations of sorting and administering said doses.

These known containers can be for example bottles, flasks, vials, syringes, cartridges, for example those used in the syringes themselves for administering anesthetics, or other drugs, and suchlike.

These known containers are transported, and often filled, by disposing them neatly inside racks, or trays, also known to persons of skill in the art by the English term "nest", housed inside slightly larger trays, also known to persons of skill in the art by the English term "tub".

To guarantee the contents of the containers are protected from the risk of external contamination and to prevent the leakage of substances contained inside the containers, for example following breakage or damage during transport, the trays are sealed inside a first packaging, or bag, usually made of thin, flexible polymeric material, or also, at least partly, of breathable material, as defined above, such as for example a filter paper, or a compound of high density polyethylene fibers, for example the well-known tyvek.

Therefore, the composition and molecular structure of these particular materials make them very suitable for use in the chemical, medical, pharmaceutical, or cosmetic sectors, since they can be subjected to treatments and processes even in controlled and/or sterile environments.

An example of this type of packaging is described in the United States document US 2011/0139050 A1 in which said first packaging configured to contain a medical device is formed by a bag provided with a breathable membrane, made with one of said materials as above to allow the passage of a sterilizing gas inside the bag.

Furthermore, in some solutions, the first packaging containing the tray is in turn sealed inside a second packaging, or bag, also made of a similar material to that of the first packaging, to increase the safety factor, facilitate transport and allow, for example, to apply barcodes or QR codes on the second packaging, which will make the automated recognition of the contents of the packagings much faster.

Furthermore, any pressure differences, for example, between the external environment and the inside of each of the packagings, do not cause the latter to swell, since the air contained inside will be free to flow, both from the inside to the outside, and also, through the micro-pores present in the material, consequently improving the transportability and ease of storage of the packagings and the objects contained therein.

This kind of packaging is very efficient also and above all in automatic processing lines, where the various industrial machines and robots can recognize and process the various sealed trays inside the packagings, without requiring the intervention of external operators and guaranteeing a high speed of execution and a high level of safety in the process, especially when having to operate in a sterile environment.

To extract the individual objects from each packaging, it will therefore be sufficient for an operator, or an automated apparatus, to identify the opening flap of each packaging, which is usually disposed on one side of the latter, to cut it and to extract the contents.

However, especially when an automated machine is used, the identification of the opening flap could be particularly difficult, in the event that it has undergone deformation or wrinkling, sometimes making it difficult, or even impossible, to automatically recognize the flap itself and to open it, for example by means of a cut.

In particular, from document DE 102014201967 A1 an apparatus is known which, in order to identify the opening flap of a sealed packaging, is provided with a pointed tubular element, or needle, which is inserted inside the packaging itself in order to blow air under pressure or other gases inside it and inflate it, like a balloon, to facilitate identification of the opening flap to be cut.

However, the insertion of the needle inside the sealed packaging implies that it must be sterilized before each use, for example, by washing it in an alcohol solution, or by heating the pointed element itself, thus making the corresponding method too long and laborious.

Moreover, this known solution is not very suitable when it is necessary to treat packagings and containers which contain chemical, pharmaceutical and/or cosmetic substances inside them, which could, for example, react with the air blown in, or be damaged by the needle during perforation, thus compromising their quality, and in some cases their usability.

There is therefore a need to provide an apparatus able to stretch an opening flap of a closed packaging containing one or more objects, especially containers for the chemical, medical, pharmaceutical or cosmetic sectors, in order to facilitate the identification of the opening flap, which overcomes at least one of the disadvantages of the state of the art, and which is able to operate on an automated processing line, especially when processing in a sterile environment is required.

One purpose of the present invention is therefore to provide an apparatus and to perfect a corresponding method for stretching an opening flap of a closed packaging containing at least one object, for example a container for the chemical, medical, pharmaceutical or cosmetic sectors, in order to facilitate the identification of the opening flap of the packaging.

Another purpose of the present invention is to provide an apparatus and to perfect a corresponding method for stretching an opening flap of a closed packaging containing at least one object, for example a container for the chemical, medical, pharmaceutical or cosmetic sectors, which can function in an automated manner and without the need for intervention by an operator.

Another purpose of the present invention is to provide an apparatus and to perfect a corresponding method for stretching an opening flap of a closed packaging containing at least one object, for example a container for the chemical, medical, pharmaceutical or cosmetic sectors, which guarantee high hygienic standards, and which therefore do not subject the contents to the risk of contamination.

Another purpose of the present invention is to provide an apparatus and to perfect a corresponding method for stretching an opening flap of a closed packaging containing at least one object, in which the apparatus can inflate the inside of the packaging without making it necessary to perforate the packaging.

Another purpose of the present invention is to provide an apparatus and to perfect a corresponding method for stretching an opening flap of a closed packaging containing at least one object, for example a container for the pharmaceutical sectors, in which the apparatus can inflate the inside of the packaging without making it necessary to subject the apparatus or one or more of its components to repeated sterilizations.

Another purpose of the present invention is to provide an apparatus and to perfect a corresponding method for stretching an opening flap of a closed packaging containing at least one object, for example a container for the chemical, medical, pharmaceutical or cosmetic sectors, without the risk of damaging its contents.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, there is provided an apparatus for stretching an opening flap of a closed packaging, containing at least one object, wherein the packaging has at least one breathable portion made of a breathable material. The apparatus comprises support means configured to keep the packaging, together with the object contained therein, stationary in a stable position, at least temporarily, with the breathable portion in an accessible position, and it also comprises insufflation means configured to couple with the breathable portion, without passing through the packaging and therefore without entering the packaging, in order to selectively insufflate gas under pressure into the packaging through the breathable portion, in order to inflate the packaging, until the opening flap is stretched so as to make it identifiable and available for a subsequent treatment, in particular a cutting of the stretched flap. The insufflation means couple with the breathable portion in order to insufflate the gas under pressure when the packaging is kept stationary in the stable position by the support means.

In accordance with one aspect of the present invention, the apparatus also comprises movement means configured to selectively command a relative movement between the insufflation means and the breathable portion of the packaging, in order to take the insufflation means into contact with the breathable portion so as to produce a sealed coupling, at least temporary, but stable.

In accordance with another aspect of the present invention, the insufflation means comprise coupling means configured to selectively produce a temporary coupling with the breathable portion of the packaging.

In accordance with another aspect of the present invention, the insufflation means comprise an insufflation chamber configured to be put in communication with the breathable portion, with a coupling between the insufflation chamber and the breathable portion such as to isolate the insufflation chamber from the outside. In other words, the insufflation chamber is disposed in correspondence with the coupling means.

In accordance with another aspect of the present invention, the insufflation means also comprise sealing means, preferably associated with the coupling means in correspondence with the insufflation chamber and configured to contact the breathable portion of the packaging and produce a seal, in particular a hermetic seal, in a coupling zone between the insufflation means and the breathable portion.

In accordance with another aspect of the present invention, the apparatus also comprises compressor means configured to feed gas at a determinate pressure.

In accordance with another aspect of the present invention, inside the insufflation chamber there are one or more emission holes, fluidically connected to the compressor means.

In accordance with another aspect of the present invention, at least the insufflation means are associated with a robot, or with a part of it, or with a mechanical arm.

In accordance with another aspect of the present invention, the support means comprise a support device which in turn comprises a lower wall, two lateral walls and a rear wall, which together define a containing compartment with sizes such as to allow a correct and stable rest of the packaging, with the object inside it, with the breathable portion in an accessible position. In other words, the breathable portion faces toward the outside, that is, the opposite side with respect to the rear wall.

In accordance with another aspect of the present invention, the apparatus is sized and configured to be inserted in a sterilized and/or controlled atmosphere containing compartment.

In accordance with another aspect of the present invention, there is provided a method to stretch an opening flap of a closed packaging containing at least one object and having at least one breathable portion made of a breathable material, wherein the method comprises the following steps:

a) disposing the packaging containing the at least one object on support means to keep it stationary in a stable position, at least temporarily, with the breathable portion in an accessible position;
b) providing gas insufflation means, in particular to position them in front of the breathable portion of the packaging;
c) coupling the insufflation means with the breathable portion of the packaging taking the insufflation means into contact with the breathable portion so as to produce a sealed coupling, at least temporary, but stable, without passing through the packaging and therefore without entering the packaging; and subsequently
d) driving the insufflation means while constantly keeping the insufflation means outside the packaging, so as to introduce a flow of gas under pressure inside the packaging, through the breathable portion, in order to inflate the packaging until the opening flap is stretched, so as to make it identifiable and accessible for a subsequent treatment, in particular a cutting of the stretched flap.

According to another aspect of the present invention, the object comprises a tray, also called a nest, housing a plurality of containers.

According to another aspect of the present invention, there is provided a unit for stretching and cutting an opening flap of a packaging containing at least one object, wherein the packaging has at least one breathable portion made of a breathable material. The unit comprises both an apparatus as described above, and also a cutting device configured to cut the opening flap after it has been stretched by the apparatus according to the present invention.

BRIEF DESCRIPTION OF THE DRAWINGS

These and other aspects, characteristics and advantages of the present invention will become apparent from the following description of some possible embodiments, given as a non-restrictive example with reference to the attached drawings wherein.

Figure 2:
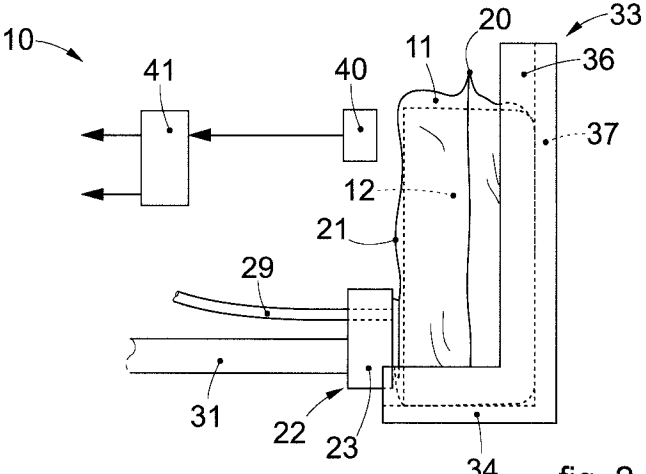
FIG. 2 is a lateral view of the apparatus of FIG. 1, in a second operating condition.
Figure 4:
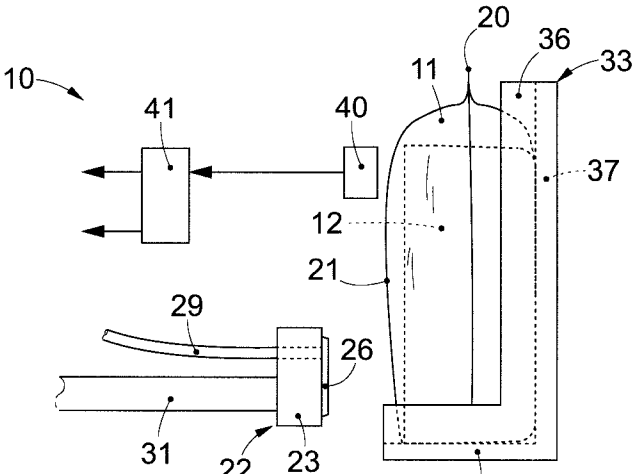
FIG. 4 is a lateral view of the apparatus of FIG. 1, in a fourth operating condition.

We must clarify that in the present description and in the claims, the terms horizontal, high, internal, external and lower with their declinations, have the sole function of better illustrating the present invention with reference to the drawings and must not be in any way used to limit the scope of the invention itself, or the field of protection defined by the attached claims. For example, by the term vertical we mean a plane that is orthogonal to the line of the horizon, or inclined, even by several degrees, for example up to 20°, with respect to the latter.

Furthermore, the terms packaging and bag are to be considered as synonyms.

In addition, the person of skill in the art will recognize that certain sizes or characteristics in the drawings may have been enlarged, deformed or shown in an unconventional or non-proportional way to provide a version of the present invention that is easier to understand.

When sizes and/or values are specified in the following description, the sizes and/or values are provided for illustrative purposes only and must not be construed as limiting the scope of protection of the present invention, unless such sizes and/or values are present in the attached claims.

To facilitate comprehension, the same reference numbers have been used, where possible, to identify identical common elements in the drawings. It is understood that elements and characteristics of one embodiment can conveniently be incorporated into other embodiments without further clarifications.

DESCRIPTION OF SOME EMBODIMENTS OF THE PRESENT INVENTION

Figure 1:
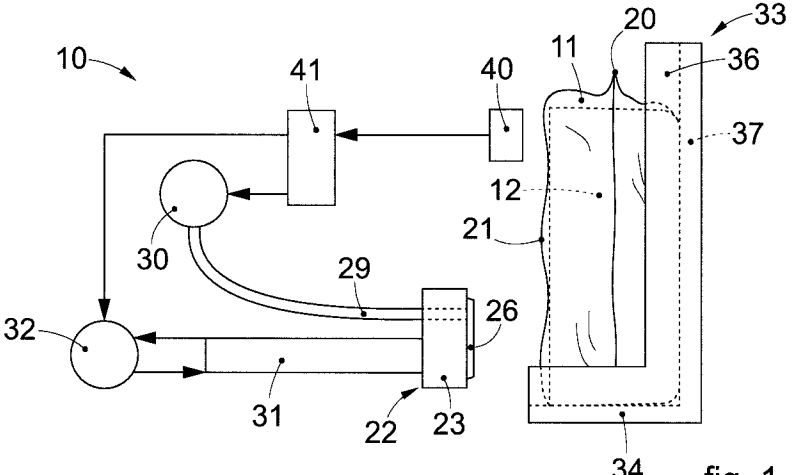
FIG. 1 is a lateral view of an apparatus for automatically stretching an opening flap of a closed packaging according to the present invention, which also shows a packaging with an object inside it, in a first operating condition.

With reference to FIG. 1, an apparatus 10 according to the present invention is configured to facilitate the automatic opening of a closed packaging 11 containing at least one object 12, for example a container for the chemical, medical, pharmaceutical or cosmetic sectors. The apparatus 10, for example, can be disposed in an automated processing line of a known type, or which will be developed in the future, and which is not shown in the drawings.

Before describing the apparatus 10 in detail, we will now describe an example of the packaging 11 and of the object 12, for indicative and non-limiting purposes.

Figure 8:
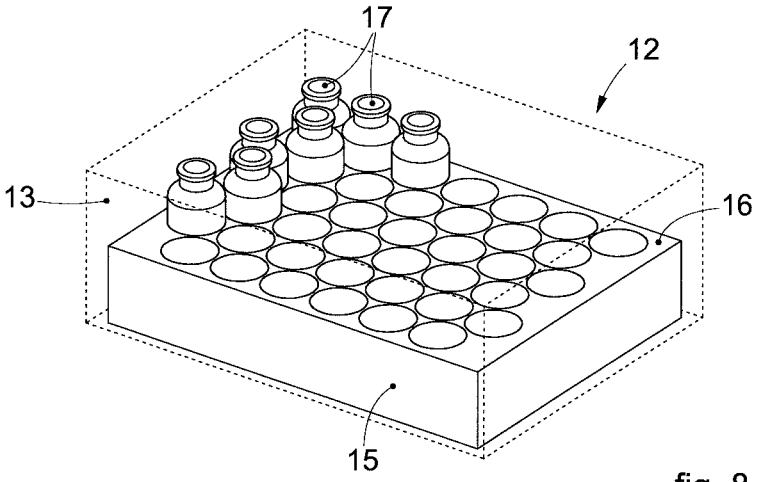
FIG. 8 is a perspective and schematic view of an object contained in a packaging which can be handled by the apparatus of FIG. 1.

Each object 12 (FIG. 8) can comprise, or consist of, a first rigid or semi-rigid container 13 substantially in the shape of a parallelepiped, in which, as is known in the state of the art, other containers can be disposed, such as for example a tub 15, which in turn contains a rack, tray, or nest, 16, which in turn can contain chemical and/or pharmaceutical products, enclosed in flasks, vials, bottles or suchlike, collectively indicated with 17.

For example, in an application in the pharmaceutical field, the standard sizes of an object 12 can be approximately 65×40×30 cm.

Figure 7:
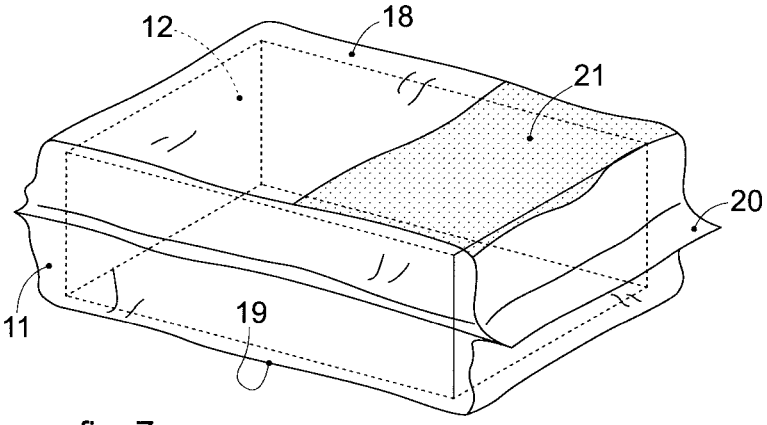
FIG. 7 is a perspective view, on an enlarged scale, of a packaging, with an object inside it, which can be handled by the apparatus in FIG. 1.

The packaging 11 (FIG. 7), for example, can comprise or consist of a bag formed by two sheets 18, 19, parallel and joined to each other, for example by means of electro-welding, along their perimeter edges, so as to define an opening flap 20 or folded flap, as is known in the state of the art.

Each of the two sheets 18, 19 therefore defines an external surface of the packaging 11.

In accordance with one aspect of the present invention, at least one breathable portion 21 of at least one of the two sheets 18, 19 of the packaging 11 is made of breathable material, as defined above.

In the specific embodiment described and shown here, the breathable portion 21 is present only in a lower zone of the sheet 18, it being understood that in other embodiments the entire sheet 18 and/or 19 could be made of the breathable material as above.

The presence of at least one breathable portion 21 with a filtering function also allows greater ease of transport and storage of the packaging 11 containing the object 12, for example, in circumstances in which the pressure of the external environment has a different value, even by a number of bars, to the one inside the packaging 11. For example, in air transport, this phenomenon could lead to a swelling of the packaging 11, leading to a rupture or explosion thereof, thus risking to irreparably damage the object 12 contained inside it. The bag serves to preserve the sterility of the content; its damage or breakage outside the dedicated environment would defeat its purpose and the product contained inside it would be unusable.

Please note that in other possible embodiments of the present invention, not shown in the drawings, the packaging 11 could have different shapes from the one just described, and/or consist of a different number of sheets, for example three or more.

Furthermore, the packaging 11 normally has a containing capacity sufficiently greater than the volume of the object 12, so that the latter, while remaining sealed in the packaging 11, can move inside it with ample play. For example, the volume of the packaging 11 is at least 20%, up to 100%, greater than the volume of the object 12.

The other parts of the packaging 11, different from the breathable portion 21, can be made of any suitable thin, flexible and deformable material, so that it can adapt to the shape of the object 12, such as for example polymeric material, for example a non-woven fabric, consisting of high-density polyethylene fibers, tearproof but easy to cut.

In other words, the packaging 11, during use, usually takes the shape of the object 12 contained therein, possibly collapsing around it.

The apparatus 10 comprises an insufflation device 22 (FIGS. 1 to 5) configured to insufflate a gas under pressure into the packaging 11, through the breathable portion 21 and without it ever entering the packaging 11, not even with one of its part, as will be described in detail below. The gas can be a suitable sterilizing gas, of the type commonly used for its sterilizing properties, or air, or a mixture thereof.

In particular, the insufflation device 22 comprises a coupling head 23 (FIG. 5) configured to go into contact with the breathable portion 21 and create a coupling with the latter, preferably sealed.

In this case, the coupling head 23 comprises a front surface 24 in which an insufflation chamber or recess 25 is made, having a width substantially equal to, or slightly smaller than, that of the breathable portion 21.

A sealing packing 26 is disposed on the front surface 24 in correspondence with the periphery of the insufflation chamber 25, and it is suitable to contact the external surface of the breathable portion 21 in order to produce, during use, a hermetically sealed coupling with the latter, that is, such as to prevent the air insufflated into the breathable portion 21 from being dispersed into the external environment.

The packing 26 is conveniently made of rubber, silicone, or other yielding or deformable material and it protrudes by a few millimeters, for example from 1 to 10 mm, with respect to the front surface 24 of the coupling head 23.

Figure 5:
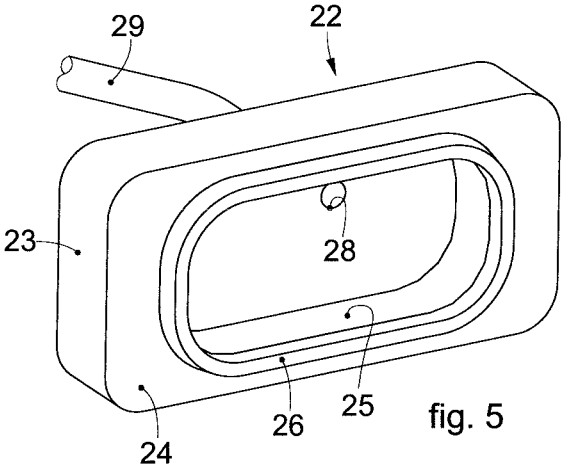
FIG. 5 is a perspective view, on an enlarged scale, of a first detail of the apparatus of FIG. 1.

Inside the insufflation chamber 25 there are one or more emission holes 28, of which only one is visible in FIG. 5, fluidically connected to a duct 29 of the flexible type, which is in turn connected to compression means 30 of a known type, for example consisting of a compressor (FIG. 1), and configured to feed gas at a determinate pressure, for example comprised between about 0.1 bar and about 6 bar. The number, size and position of both the emission holes 28 and also the ducts 29 can vary as a function of the sizes of the insufflation chamber 25 and/or the pressure of the insufflated gas.

Figure 3:
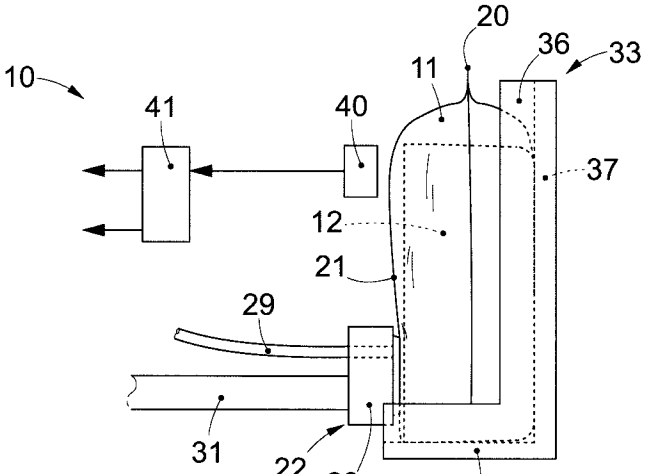
FIG. 3 is a lateral view of the apparatus of FIG. 1, in a third operating condition.

The insufflation device 22 is configured to be moved between an idle position, in which its head 23 is distanced from the breathable portion 21 (FIGS. 1 and 4), to an operating position, in which the same head 23 is in contact with the breathable portion 21, and vice versa (FIGS. 1 and 3). The movement between the two positions can be carried out in any known way, for example by means of a mechanical arm 31 commanded by an actuation device 32 or by an automated robot.

The apparatus 10 also comprises a support device 33 (FIGS. 1 to 4), configured to support the packaging 11 and the object 12 contained therein in a determinate operating position, to allow the insufflation device 22 to collaborate with the breathable portion 21 in order to highlight the opening flap 20, as will be described in detail below.

Figure 6:
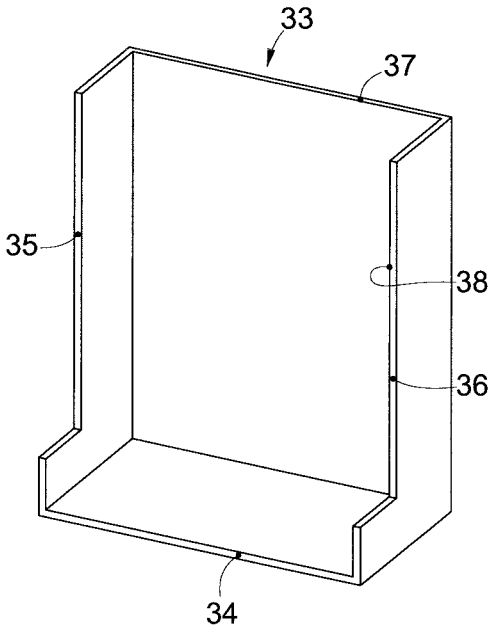
FIG. 6 is a perspective view, on an enlarged scale, of a second detail of the apparatus of FIG. 1.

The support device 33 comprises a lower wall 34 (FIG. 6), two lateral walls 35 and 36 and a rear wall 37, which together define a containing compartment 38 with sizes such as to allow a correct and stable rest of the packaging 11, with the object 12 inside it, against the lower 34 and rear 37 walls, in particular with the breathable portion 21 (FIG. 1) disposed in an accessible position. In particular, the breathable wall 21 can be facing toward the outside, that is, the opposite side with respect to the rear wall 37.

In the embodiment described here, the support device 33 (FIGS. 1 to 4) is stationary in a determinate position with respect to the insufflation device 22, with the rear wall 37 which can be disposed either parallel to a vertical plane or inclined backward by a few degrees with respect to the latter.

In other embodiments, not shown in the drawings, the support device 33 could be installed, for example, on the end of a mechanical arm or of an automated robot, of a type known per se and not shown in the drawings, and configured to incline the support device 33 as desired, and/or take the breathable portion 21 of the packaging 11 temporarily into contact with the insufflation device 22, or alternatively to take the packaging 11 containing the object 12 to a work station disposed downstream of the apparatus 10, once the opening flap 20 of the packaging 11 has been stretched.

Furthermore, according to other alternative embodiments, not shown in the drawings, the lateral walls 35 and 36 could be mobile and be associated with a suitable command device to selectively clamp the packaging 11 and the object 12 contained therein during the step of inflating the packaging 11 itself, as described in detail below.

Furthermore, the apparatus 10 comprises a sensor 40, of a type known per se, installed above the insufflation device 22 and configured to detect the state of inflation of the packaging 11.

The sensor 40 is electrically connected to a control unit 41 (FIG. 1), configured to receive the signals coming from the latter and send corresponding actuation signals to the compression means 30 and to the actuation device 32.

The functioning of the apparatus 10 described heretofore, which also corresponds to the method to make it function, is as follows.

Initially, in a first operating step, a packaging 11, together with the object 12 contained therein, is disposed and positioned on the support device 33 (FIG. 1), for example by means of automated means of a known type, such as conveyor belts, mechanical arms, or automated robots, in a first operating position. Movement means that do not produce particulate matter, for example planar engines, will be favored. However, it must be clear that this operation of positioning the packaging 11, together with the object 12 contained therein, can also be done manually.

In this first operating position, the packaging 11 and the object 12 are kept stationary, at least temporarily, so that the breathable portion 21 of the packaging 11 is in an accessible position, that is, facing toward the outside, that is, toward the insufflation device 22.

Therefore, the second sheet 19 of the packaging 11 will be in contact with the rear wall 37 of the support device 33, the opening flap 20 will be facing upward, and the object 12 contained inside the packaging 11 will therefore be stably and temporarily disposed on the support device 33. Furthermore, the breathable portion 21 is not in contact with the walls 34, 35, 36 and 37 of the support device 33, and will therefore be available to be contacted by the insufflation device 22.

Subsequently, in a following step, a relative movement is made between the insufflation device 22 and the breathable portion 21 of the packaging 11, in order to take the insufflation device 22 into contact with the breathable portion 21 (FIG. 2) and produce a sealed coupling between them, at least temporary, but stable, constantly keeping every part of the insufflation device 22 outside the packaging 11. In this way, the insufflation device 22 does not pass through the packaging 11 and does not enter inside it.

In particular, in the embodiment described here, the control unit 41, by means of the actuation device 32, drives the mechanical arm 31 which takes the insufflation device 22 from its idle position (FIG. 1), in which its head 23 is distanced from the breathable portion 21, to its operating position (FIG. 2), so that the coupling head 23 comes into contact with the breathable portion 21.

In other entirely equivalent embodiments, the support device 33 could be moved against the insufflation device 22.

That is, the insufflation device 22 can remain in position, and the packaging 11 can be taken into contact with the insufflation device 22.

In particular, the packing 26 will adhere to the external surface of the breathable portion 21, thus guaranteeing a hermetic seal between the insufflation chamber 25 and the breathable portion 21.

To guarantee the correct coupling between the coupling head 23 and the breathable portion 21 of the packaging 11, the mechanical arm 31 will conveniently apply a force to the insufflation device 22 such as to guarantee the correct adhesion of the packing 26 to the breathable portion 21 itself. The same force also has to guarantee an adequate resistance to the thrust, in the opposite sense, caused both by the flow of gas under pressure at exit from the insufflation device 22 and also by the action of inflating the packaging 11.

If the insufflation device 22 were installed on the mechanical arm of a robot, for example anthropomorphic, the latter could be programmed to automatically take the coupling head 23 into contact with the breathable portion 21 of the packaging 11 containing the object 12.

Subsequently, the insufflation device 22, while it remains in its operating position, is driven in such a way as to introduce a flow of air, or other gas, under pressure inside the packaging 11, through the breathable portion 21, thus creating an inflation of the packaging 11, to consequently make the opening flap 20 better identifiable, at least with respect to the remaining part of the packaging 11, and available for a possible subsequent treatment thereof.

In particular, the control unit 41 can command the compression means 30 when it receives an enabling signal from at least one possible proximity sensor, of a known type and not shown in the drawings, suitable to detect that contact has occurred between the insufflation device 22 and the breathable portion 21.

The activation of the compression means 30 generates a flow of gas under pressure which, passing through the duct 29, flows into the emission hole 28 of the insufflation chamber 25 and enters the packaging 11 through the breathable portion 21.

Consequently, the upper part of the packaging 11 is inflated, the sheets 18 and 19, as well as the upper opening flap 20, stretch flap that is more visible and more easily identifiable and available for subsequent processing.

When the internal volume of the packaging 11 reaches a programmed and desired value, the inflation sensors 40 send corresponding signals to the control unit 41, which consequently deactivates the compression means 30 so that the flow of gas under pressure directed inside the packaging 11 is interrupted.

Therefore, the identification of the opening flap 20 is much easier, faster and more intuitive, even for apparatuses or automated machines of a known type, or ones that will be developed in the future, which can then carry out the automated opening of the opening flap 20 itself.

Subsequently, the coupling head 23 and the breathable portion 21 of the packaging 11 are decoupled, and the insufflation device 22 returned to its idle position (FIG. 4) by means of the actuation device 32 commanded by the control unit 41.

The packaging 11 containing the object 12 can therefore be picked up and moved, for example toward a subsequent cutting station or any other work station whatsoever, by means of movement members, for example conveyor belts, or fluid-dynamic grippers, installed for example on a mechanical arm or an automated robot.

Figure 9:
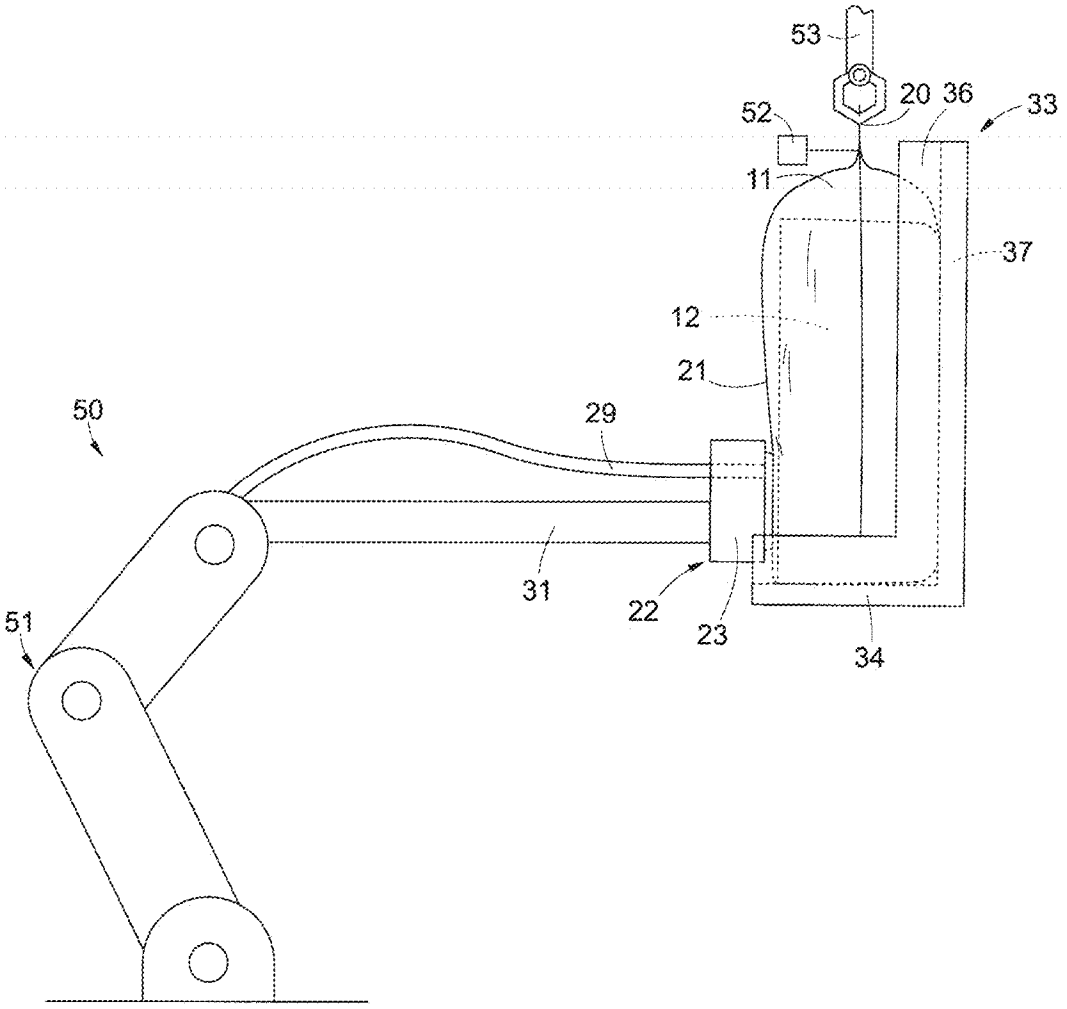
FIG. 9 is a schematic lateral view of a unit for stretching and cutting an opening flap of a closed packaging, comprising an apparatus according to the present invention.

By way of example, with particular reference to FIG. 9, the apparatus 10 can advantageously be used in the context of a unit for stretching and cutting the opening flap 20, identified as a whole by the reference number 50, and hereafter also referred to only as "unit" for brevity. The unit 50 comprises the apparatus 10. In the example shown, the mechanical arm 31 is associated with a robot 51, for example a robot with six degrees of freedom comprising a plurality of reciprocally articulated arms.

The unit 50 also comprises a cutting device 52, of a known type and not described here in detail. The cutting device 52 comprises a mobile or fixed cutting blade, or an equivalent cutting or shearing member able to cut the opening flap 20 to separate it from the packaging and thus determine its opening.

As a function of the conformation of the cutting device 52, the unit 50 can comprise a gripping member 53, configured to grip the free end of the opening flap 20 at least during the cutting, in such a way as to keep it well stretched and thus facilitate the cutting operation performed by the cutting device 52.

From the previous description, it is clear that the apparatus 10, and the unit 50 that comprises it, previously described are configured to also be inserted in a sterilized and/or controlled atmosphere compartment or work space.

It is clear that modifications and/or additions of parts or steps may be made to the apparatus 10, to the unit 50 and to the method as described heretofore, without departing from the field and scope of the present invention as defined by the claims.

It is also clear that, although the present invention has been described with reference to some specific examples, a person of skill in the art shall certainly be able to achieve many other equivalent forms of apparatuses and/or methods for automatically stretching the opening flap of a closed packaging, all coming within the field and scope of the present invention.

In the following claims, the sole purpose of the references in brackets is to facilitate reading and they must not be considered as restrictive factors with regard to the field of protection defined thereby.

The invention claimed is:

1. Apparatus for stretching an opening flap of a closed packaging containing at least one object, wherein said packaging has at least one breathable portion, made of a breathable material, said apparatus comprising:

support means configured to keep said packaging, together with said object contained therein, stationary in a stable position, at least temporarily, with said breathable portion in an accessible position, insufflation means configured to couple with said breathable portion, without passing through said packaging and therefore without entering said packaging, and to selectively insufflate gas under pressure into said packaging through said breathable portion, in order to inflate said packaging until said opening flap is stretched, so as to make said opening flap identifiable and available for a subsequent cutting of the stretched flap, said insufflation means coupling with said breathable portion in order to perform the insufflation of the pressurized gas when said packaging is held stationary in the stable position by said support means, wherein said insufflation means comprise an insufflation chamber configured to be put in communication with said breathable portion, with a coupling between said insufflation chamber and said breathable portion such as to isolate the insufflation chamber from the outside, and wherein the apparatus further comprises compressor means configured to feed gas at a determinate pressure, wherein, inside said insufflation chamber, there are one or more emission holes fluidically connected to said compressor means.

2. Apparatus as in claim 1, further comprising movement means configured to selectively command a relative movement between said insufflation means and said breathable portion of said packaging in order to take said insufflation means into contact with said breathable portion so as to produce a sealed coupling, at least temporary, but stable.

3. Apparatus as in claim 1, wherein said insufflation means comprise coupling means configured to selectively produce a temporary coupling with said breathable portion of said packaging.

4. Apparatus as in claim 1, wherein said insufflation means also comprise sealing means configured to contact said breathable portion of said packaging and produce a seal with respect to the outside, in a coupling zone between said insufflation means and said breathable portion.

5. Apparatus as in claim 1, wherein at least said insufflation means are associated with a robot, or with a part of it, or with a mechanical arm.

6. Apparatus as in claim 1, wherein said support means comprise a support device which in turn comprises a lower wall, two lateral walls and a rear wall, which together define a containing compartment with sizes such as to allow a correct and stable rest of said packaging, with said object inside it, with said breathable portion in an accessible position.

7. Apparatus as in claim 1, being sized and configured to be inserted in a sterilized and/or controlled atmosphere containing compartment.

8. Unit for stretching and cutting an opening flap of a packaging containing at least one object, wherein said packaging has at least one breathable portion made of a breathable material, wherein said unit comprises the apparatus as in claim 1 and a cutting device configured to cut said opening flap after it has been stretched by said apparatus.

9. Method to stretch an opening flap of a closed packaging, said method comprising:

a) providing a closed packaging containing at least one object and having at least one breathable portion made of a breathable material that is a material which allows the passage of air, or other gases, and prevents the passage of liquids and microorganisms;

b) disposing said packaging containing said at least one object on support means in order to keep it stationary in a stable position, at least temporarily, with said breathable portion in an accessible position;

c) providing insufflation means of gas;

d) coupling said insufflation means with said breathable portion of said packaging, taking said insufflation means into contact with said breathable portion, so as to produce a coupling, at least temporary, but stable, without passing through said packaging and therefore without entering said packaging; and subsequently e) driving said insufflation means constantly keeping said insufflation means outside said packaging, so as to introduce a flow of gas under pressure inside said packaging, through said breathable portion, in order to inflate said packaging until said opening flap is stretched, so as to make said opening flap identifiable and accessible for a subsequent cutting of the stretched flap.

10. Method as in claim 9, wherein said at least one object comprises a nest, housing a plurality of containers.

11. Apparatus for stretching an opening flap of a closed packaging containing at least one object, wherein said packaging has at least one breathable portion, made of a breathable material, said apparatus comprising:

support means configured to keep said packaging, together with said object contained therein, stationary in a stable position, at least temporarily, with said breathable portion in an accessible position, insufflation means configured to couple with said breathable portion, without passing through said packaging and therefore without entering said packaging, and to selectively insufflate gas under pressure into said packaging through said breathable portion, in order to inflate said packaging until said opening flap is stretched, so as to make said opening flap identifiable and available for a subsequent cutting of the stretched flap, said insufflation means coupling with said breathable portion in order to perform the insufflation of the pressurized gas when said packaging is held stationary in the stable position by said support means, wherein said support means comprise a support device which in turn comprises a lower wall, two lateral walls and a rear wall, which together define a containing compartment with sizes such as to allow a correct and stable rest of said packaging, with said object inside it, with said breathable portion in an accessible position.

* * * * *